United States Patent [19]

Whitehurst et al.

[11] Patent Number: 4,496,465

[45] Date of Patent: Jan. 29, 1985

[54] WET-PROCESS PHOSPHORIC ACID BRIGHTENING REAGENT FOR ALUMINUM

[75] Inventors: Brooks M. Whitehurst, New Bern; Donald F. Clemens, Greenville; Taylor King, Beaufort; Garnett B. Whitehurst, New Bern, all of N.C.

[73] Assignees: Whitehurst Associates, Inc.; Encee Chemical Sales, Inc., both of New Bern, N.C. ; a part interest

[21] Appl. No.: 604,463

[22] Filed: Apr. 27, 1984

Related U.S. Application Data

[62] Division of Ser. No. 425,573, Sep. 28, 1982.

[51] Int. Cl.[3] ..... C09K 13/04; C09K 13/08; C09K 13/06; C23F 1/00

[52] U.S. Cl. ..... 252/79.2; 156/665; 156/903; 252/79.3; 252/79.4

[58] Field of Search ..... 252/79.2, 79.3, 79.4, 252/142; 156/665, 903; 204/129.1, 129.9; 134/3, 41; 423/299, 308–311, 317

[56] References Cited

U.S. PATENT DOCUMENTS

| | | | |
|---|---|---|---|
| 2,729,551 | 1/1956 | Cohn | 156/903 X |
| 3,202,612 | 8/1965 | Nelson | 156/903 X |
| 3,410,803 | 11/1968 | Hoover | 252/79.2 |

*Primary Examiner*—William A. Powell
*Attorney, Agent, or Firm*—John S. Roberts, Jr.

[57] ABSTRACT

This invention teaches the development of a chemical reagent useful as an aluminum brightening bath. The reagent's composition is primarily wet-process phosphoric acid to which has been added small quantities of nitric acid, copper, and optionally traces of several other substances. The reagent does not require expensive removal of the natural impurities found in wet-process phosphoric acid.

4 Claims, No Drawings

WET-PROCESS PHOSPHORIC ACID BRIGHTENING REAGENT FOR ALUMINUM

This is a division of application Ser. No. 425,573, filed Sept. 28, 1982.

PRIOR ART STATEMENT

Kirk-Othmer, *Encyclopedia of Chemical Technology*, 3d ed., Vol. 17, pp. 426 et seq. contain background information and detailed discussion of furnace grade phosphoric acid and wet-process phosphoric acid.

U.S. Pat. No 2,650,157 Cochran teaches the chemical brightening of aluminum using furnace or thermal acid mixed with nitric or acetic acid.

U.S. Pat. No. 2,678,875 Spooner teaches the chemical brightening of aluminum using furnace acid plus nitric, acetic, or silicic acid. At operating temperature, this bath is viscous.

U.S. Pat. Nos. 2,593,448 and 2,593,449 (both to Hesch) teach the chemical brightening of aluminum using a composition consisting primarily of water with traces of furnace grade phosphoric acid, nitric acid, HF, $CaO_3$, and $Cu(NO_3)_2$.

The present invention teaches the use of wet-process phosphoric acid in a solution containing primarily phosphoric acid and does not require removal of the natural impurities found in the starting acid. The bath is not viscous at the operating temperature and does contain trace amounts of other substances which enhance the chemical brightening process.

UTILITY STATEMENT

The aluminum brightening bath of this invention is a useful, economical, and efficient brightening reagent for aluminum.

BACKGROUND

The conventional means of polishing or brightening aluminum uses phosphoric acid produced by the thermal process, known as the furnace process. This acid is manufactured in small quantities from elemental phosphorus, is more expensive and considerably more pure, and is usually reserved for processes requiring high purity phosphorus.

Wet process acid, on the other hand, is manufactured in large quantities directly from phosphate ores, is low cost and low purity, and is used primarily for fertilizers purified with a technical grade of phosphate salts.

Usually wet-process phosphoric acid is supersaturated with a group of sludge-forming components (Fe, Al, Ca, Mg, Cu, F, Na, K, Si, and $SO_4$) that must be removed if purified phosphate salts are needed. However, the purification process is difficult and always results in the loss of phosphate values. Additionally, wet-process phosphoric acid is purified by solvent extraction, utilizing a number of different solvents including alcohols, such as amylbutylalcohol, or various ethers. These solvents tend to leave organic residues in the purified wet acid which react with the nitric acid in an aluminum polishing bath. For this reason, the aluminum cleaning industry customarily uses initially purer furnace grade phosphoric acid in its metal treatment processes due to the lower level of impurities.

The present invention teaches a new phosphoric acid bath and a new method for brightening aluminum. The primary acid is not the furnace acid customarily used, but wet-process phosphoric acid. This invention also teaches a method of producing an acid bath suitable for cleaning aluminum that is operable without the expensive extraction processes necessary to remove contaminants from wet-process acid. These contaminants, the ones listed above and in particular Mg, Fe, and Al, have heretofore reduced the effectiveness of conventional aluminum brightening baths. This invention also teaches a new aluminum brightening acid bath that does not require purifying the bath of all organic residues oxidizable in nitric acid. Other objects and advantages of this invention will become obvious to those skilled in the art from the following description.

In the typical process, an aluminum piece is immersed in a polishing bath for 0.5 to 4.0 minutes at a temperature of 102° C. to 112° C. The brightening bath contains approximately 80–50% phosphate acid and 3% nitric acid plus certain enhancers and defoaming agents.

The actual brightening of the metal surface is an electrochemical reaction—aluminum dissolves at the anodic sites and hydrogen evolves at the cathodic site. Microscopic galvanic cells cause an etching of the surface which, when properly controlled, produces a brightened surface. Chemical polishing occurs as minute protrusions on the surface of the metal are attacked, resulting in an increase in luminous reflectance. One method of controlling the polishing is the addition of heavy metal ions such as copper. These ions are cathodically reduced, forming a thin uniform precipitate on the surface of the aluminum.

Most brightening processes in the United States today use baths whose main constituent is phosphoric acid, a small amount of nitric acid, and a trace amount of copper. The present invention teaches a more complex bath, containing a variety of metal ions with 2+ and 3+ valences as well as specific amounts of sulfate and fluoride ions. The sulfate and fluoride ions inhibit the anodic attack while some of the metal ions are cathodically reduced to form a protective film on the aluminum surface.

DESCRIPTION OF THE INVENTION

Contrary to the conventional method of brightening aluminum using furnace grade phosphoric acid, the present invention uses a wet-process phosphoric acid as the basis for the brightening bath. Certain impurities common to wet-process phosphoric acid-the oxides of Fe, Cr, Al, and Mg—have, in the past, prevented practitioners from using wet process acid in aluminum brightening processes. By adhering to the following parameters, wet-process phosphoric acid is converted to an effective aluminum brightening reagent: (a) the bath must contain less than about 500 ppm organic substances oxidizable in nitric acid; (b) the brightening bath must not contain greater than about 3% dissolved metallic ions of Mg, Fe, and Al (as expressed in Al equivalents); (c) $Cu^{++}$ is present in the amount of 80–150 ppm.

Phosphoric acid of different strengths may be used as a starting material and is then diluted. Based on $P_2O_5$ (70%), the preferred acid is $H_3PO_4$, orthophosphoric acid. Increasing the $P_2O_5$ to stronger concentrations alters the acid from oily to a mixture of glossy and crystalline material. The actual acid is in the form of polyphosphoric acid, either di-, tri-, or tetra-phosphoric acid, also known as condensed phosphoric acid. Diluting the above acids from 80 to 50% calculated as $P_2O_5$ (and preferred 70 to 54%) brings the concentration within the tenor of the present application.

Kirk-Othmer, *Encyclopedia of Chemical Technology,* Vol. 17, 3d ed, p. 435, defines wet-process phosphoric acid as "manufactured by digestion of phosphate rock (apatite forms) with sulfuric acid; $H_3PO_4$ is separated from the resultant calcium sulfate slurry by filtration. Fresh wet-process phosphoric acid is supersaturated with a group of sludge-forming components (Fe, Al, Ca, Mg, Cu, F, Na, K, Si, and $SO_4$) that must be removed to produce high quality phosphate salts". This invention uses the wet-process phosphoric acid (starting concentration 94–70%) prior to the removal of the sludge-forming components (a process which is difficult, uneconomical, and produces a loss of phosphate values). The three metals that are primary constituents of wet-process phosphoric acid are Al, Fe, and Mg. These metals are usually present as $Al^{+++}$, $Fe^{++}$, $Fe^{+++}$, or $Mg^{++}$. A variety of processes for the removal of these metals exist; however, the purification process is costly and inefficient. This invention, however, obivates the need for removal of these metals, provided that the original wet-process acid contained sufficiently low concentrations. Maintaining a total Fe, Al, and Mg concentration below about 3% by weight produces an effective brightening bath; when these metals exceed the 3% amount, the bath crystalizes and/or produces inferior brightening finishes.

The wet-process acid, containing the sludge-forming elements recited above, is filtered and then diluted with water from a concentration of about 70% $P_2O_5$ to about 50–55% $P_2O_5$. Diluting the acid in such a manner precipitates F to such an extent that the phosphorus to F ratio increases from about 35:1 to 100:1 to even as high as about 300:1. The acid is again filtered, producing a clarified, low fluoride phosphoric acid suitable for aluminum brightening. This second filtering step removes solids from the acid which would result in pitting the surface of an aluminum piece.

With reference to other ions, optimum brightening occurs when the bath contains 570–640 ppm $F^-$, 130–170 ppm $Cr^{3+}$ and 80–130 ppm $Cu^{2+}$. The chromium affects the reduction of the oxidizing agents in the bath. The copper is considered an enhancer, stimulating the electrochemical process and improving brightness.

Nitric acid (concentration 68–73.5%) is added after the copper in a preferred amount of about 3% and an operational amount of 1–10%. The addition of nitric acid, however, presents some problems which are overcome by maintaining the level of organic compounds in the acid bath at a low level. Because the oxidizing strength of the polishing bath is very high, nitric acid readily attacks free carbons and organic compounds, thus reducing the brightening qualities of the bath. Accordingly, the level of organic substances oxidizable by nitric acid must be maintained below about 500 ppm.

A list of the ingredients follows:

| | | |
|---|---|---|
| Phosphoric acid | 80–50% | by weight |
| Nitric acid | 1–10% | by weight |
| Sulfate ions | 1.8–3.3% | by weight |
| Fluoride ions | 570–1640 | ppm |
| Chromium ($Cr^{3+}$) | 130–170 | ppm |
| Copper ($Cu^{2+}$ or $Cu^{3+}$) | 80–130 | ppm |
| Organic substances | <500 | ppm |
| Fe, Mg, Al | <3% | by aluminum equivalents |
| Fe ($Fe^{3+}$ or $Fe^{2+}$) | 0.29–0.59% | |
| Fume Inhibitors | | |

Once these ingredients are added and sufficiently mixed, the bath's temperature is raised to an operating temperature of about 90°–120° and the specific gravity maintained at about 1.6–1.8. Immersion time for an aluminum sample can vary between about 0.5 to 4.0 minutes.

EXAMPLE 1

A typical brightening bath was prepared starting with 80% wet-process phosphoric acid diluted with water to 58% concentration. To the acid was added 0.54% $Fe^{+++}$, 150 ppm $Cr^{+++}$, and 600 ppm $F^-$. To this solutin was added 100 ppm $Cu^{++}$, 3.0% $HNO_3$, and a small quantity of fume inhibitor. The specific gravity of the solution was about 1.72. The temperature was maintained at 105° C., and the aluminum samples were immersed for 3 minutes. This bath continued to function as an excellent polishing bath until the concentration of Al plus Fe reached 3%.

EXAMPLE 2

The above bath was prepared except that 0.38% Al, 0.55% Fe, and 0.25% Mg were present as contaminants in the raw acid. After adding 2.25% Al—producing a total concentration of the three metals to 3.43%—the resulting bath produced poor polishing.

EXAMPLE 3

Similarly, when 2.50% Al was added to give a total concentration of the three metals of 3.68%, the resulting bath produced very poor polishing.

EXAMPLE 4

In separate trials, 1.90% Al, 1.70% Al, and 1.50% Al was added. In each case the resulting bath produced good to very good polishing.

The results of these tests are charted below:

| Initial Concentration in Wet-Process Acid | Additive | Total Concentration of Metals | Results |
|---|---|---|---|
| 0.38% Al, 0.55% Fe, 0.25% Mg | 2.25% Al | 3.43% | Poor |
| | 2.50% Al | 3.68% | Very poor |
| | 1.90% Al | 3.08% | Good |
| | 1.70% Al | 2.88% | Very good |
| | 1.50% Al | 2.68% | Very good |

We claim:

1. A method of preparing a wet-process phosphoric acid brightening reagent which comprises diluting 80% $P_2O_5$ acid to about 50–55% $P_2O_5$ and filtering, adjusting the filtrate to a maximum of about 3% of multivalent cations selected from the group consisting of $Fe^{++}$, $Fe^{+++}$, $Mg^{++}$, $Al^{+++}$, and $Cu^{++}$ and separately adjusting the $Cu^{++}$ content to 80–150 ppm and adding about 3% $HNO_3$ (68–73.5% concentration).

2. A method according to claim 1 wherein the oxidized organic material present in the filtered acid is kept below about 500 ppm.

3. A wet process phosphoric acid treating agent comprising about 50–55% $P_2O_5$ (90–94% con.) about 3% $HNO_3$ (68–73.5% con.), polyvalent metal cations, $Fe^{++}$, $Fe^{+++}$, $Al^{+++}$, $Mg^{++}$, and $Cu^{++}$ up to about 3% in Al equivalents and $Cu^{++}$ separately adjusted to positively measure 80–150 ppm.

4. A reagent according to claim 3 wherein the oxidizable organic material in the phosphoric acid is below about 500 ppm.

* * * * *